US007121408B2

(12) United States Patent
Wilson

(10) Patent No.: US 7,121,408 B2
(45) Date of Patent: Oct. 17, 2006

(54) SUPPORT FOR BOTTLES

(75) Inventor: Malcolm William Wilson, East Malvern (AU)

(73) Assignee: Anne Brown Sculthorpe, Victoria (AU)

( * ) Notice: Subject to any disclaimer, the term of this patent is extended or adjusted under 35 U.S.C. 154(b) by 0 days.

(21) Appl. No.: 10/488,521

(22) PCT Filed: Sep. 3, 2002

(86) PCT No.: PCT/AU02/01207

§ 371 (c)(1),
(2), (4) Date: Jul. 21, 2004

(87) PCT Pub. No.: WO03/020592

PCT Pub. Date: Mar. 13, 2003

(65) Prior Publication Data

US 2004/0238398 A1 Dec. 2, 2004

(30) Foreign Application Priority Data

Sep. 4, 2001 (AU) ..... PR7487
Feb. 13, 2002 (AU) ..... PS0515
Jul. 15, 2002 (AU) ..... 2002950180

(51) Int. Cl.
*B65D 65/00* (2006.01)

(52) U.S. Cl. ..... 206/433; 206/509; 206/585

(58) Field of Classification Search ..... 206/203, 206/427, 499, 504, 509, 511, 512, 564, 585, 206/821, 518, 521.2, 587; 211/60.1, 74; 220/508, 509, 515, 516, 519
See application file for complete search history.

(56) References Cited

U.S. PATENT DOCUMENTS 1,960,279 A * 5/1934 Read ..... 206/427
1,967,026 A * 7/1934 Gray et al. ..... 206/427
2,662,649 A * 12/1953 Gill et al. ..... 206/821
3,853,221 A * 12/1974 Boyd ..... 206/523
5,335,770 A * 8/1994 Baker et al. ..... 206/564
5,950,829 A * 9/1999 Gale ..... 220/516
6,216,885 B1 * 4/2001 Guillaume ..... 206/564
6,820,743 B1 * 11/2004 Hurley et al. ..... 206/518

FOREIGN PATENT DOCUMENTS

AU 50703/96 A 11/1996

(Continued)

OTHER PUBLICATIONS

International Search Report for PCT/AU02/01207; ISA/AU; Mailed: Oct. 17, 2002.

*Primary Examiner*—Luan K. Bui
(74) *Attorney, Agent, or Firm*—Harness, Dickey & Pierce, P.L.C.

(57) ABSTRACT

A stacking support for at least one row of wine bottles is of sheet-like form with indentations (10) shaped to receive and locate at least one row of bottles in parallel relationship in a first layer. The indentations (10) are so arranged that when a second like support for carrying a second layer will be laterally offset with respect to those of the first layer so that the bottles of the second layer will be supported by the bottles of the first layer. The support is so configured that when it is used in conjunction with the second like support (16) the two supports (16) cooperate to ensure anti-sagging support in the zone of the endmost bottle-carrying indentation (10*e*) of the second layer only partially supported by the first layer.

10 Claims, 6 Drawing Sheets

FOREIGN PATENT DOCUMENTS

| | | | |
|---|---|---|---|
| DE | 19729173 | A | 1/1998 |
| EP | 604315 | A | 5/1997 |
| FR | 2247093 | A | 5/1975 |
| FR | 2562872 | A | 10/1985 |
| FR | 2600983 | A | 1/1988 |
| FR | 2781466 | A | 1/2000 |

* cited by examiner

SUPPORT FOR BOTTLES

CROSS-REFERENCE TO RELATED APPLICATIONS

This Application is a U.S. National Stage of International Application No. PCT/AU02/01207 filed 03 Sep. 2002. This application claims the benefit of Australian Application No. PR 7487. filed 04 Sep. 2001. Australian Application No. PS 0515, filed 13 Feb. 2002 and Australian Application No. 2002-950180, filed 15 Jul. 2002. The disclosure(s) of the above applications are incorporated herein by reference.

The present invention relates to a stacking support for a plurality of rows of bottles, such as wine bottles, to permit transportation and/or storage of multiple layers of bottles.

According to the invention, there is provided a stacking support for at least one row of bottles, said support being of sheet-like form with indentations shaped to receive and locate at least one row of bottles in parallel relationship in a first layer, the indentations being so arranged relative to the edges of the support that when a second like support for carrying a second layer of bottles is arranged on the bottles of the first layer, the bottles of the second layer will be laterally offset with respect to those of the first layer so that the bottles of the second layer will be supported by the bottles of the first layer, said support having at least one projection extending upwardly adjacent the end of the row to engage the second support in the zone of the endmost bottle-carrying indentation thereof only partially supported by a single bottle in the first layer.

In a preferred embodiment of the invention, the row of indentations is asymmetrically arranged relative to opposed lateral edges of the support whereby the indentation at one end of the row is closer to the adjacent edge of the support than is the indentation at the other end of the row, and said projection comprises a post extending upwardly from the support adjacent said other end of the row, and the indentation at said one end of the row is formed with an abutment surface which rests upon the post of an underlying like support in the stack orientated through 180° relative thereto.

Advantageously, the post extends upwardly from a land defined between the indentation at that end of the row and the adjacent edge of the support, and the abutment surface extends from the indentation at the said one end of the row in the zone of a laterally outer part of that indentation.

In a particularly preferred embodiment of the invention, the support has a plurality of rows of indentations with a respective said post and abutment surface being associated with each row.

Advantageously, the support comprises projections extending downwardly to engage the bases of the bottles in the underlying layer whereby to substantially prevent displacement of the stacking support relative to the underlying layer in the direction of the longitudinal axis of the bottles of that layer.

Further according to the invention, there is provided a stacking support for at least one row of bottles, said support being of sheet-like form with indentations shaped to receive and locate at least one row of bottles in parallel relationship in a first layer, the indentations being so arranged relative to the edges of the support that when a second like support for carrying a second layer of bottles is arranged on the bottles of the first layer, the bottles of the second layer will be laterally offset with respect to those of the first layer so that the bottles of the second layer will be supported by the bottles of the first layer, said support being so configured that when it is used in conjunction with the second like support the two supports cooperate to ensure anti-sagging support in the zone of the endmost bottle-carrying indentation of the second layer only partially supported by the first layer.

According to another aspect of the invention, there is provided a stacking support for at least one row of bottles, said support being of sheet-like form with indentations shaped to receive and locate at least one row of bottles in parallel relationship in a first layer, the indentations being so arranged relative to the edges of the support that when a second like support for carrying a second layer of bottles is stacked on the bottles of the first layer, the bottles of the second layer will be laterally offset with respect to those of the first layer so that the bottles of the second layer will be supported by the bottles of the first layer, said support having at least one projection to cooperate with an adjacent like support of the stack so as to substantially prevent horizontal displacement between the adjacent supports whereby a stack formed from a multiplicity of such supports will be maintained in a vertical state.

In one embodiment of the invention, the projection extends upwardly from the support so that its upper end portion engages complimentary structure at the undersurface of the upper adjacent like support in the stack. The cooperating structure may take the form of a recess in which the upper end portion of the projection is seated. In practice, the support will have several such projections and also corresponding recesses or other cooperating structure at its underside for appropriate cooperation with the adjacent support in the stack with each support in the stack being orientated through 180° with respect to the support(s) immediately underlying and/or overlying that support.

Further according to another aspect of the invention there is provided a stacking support for at least one row of bottles, said support being of sheet-like form with indentations shaped to receive and locate at least one row of bottles in parallel relationship in a first layer, the indentations being so, arranged relative to the edges of the support that when a second like support for carrying a second layer of bottles is stacked on the bottles of the first layer, the bottles of the second layer will be laterally offset with respect to those of the first layer so that the bottles of the second layer will be supported by the bottles of the first layer, said support having at least one projection to cooperate with at least one bottle of the layer immediately beneath the said first layer so as substantially prevent horizontal displacement between the respective supports in the longitudinal direction of the bottles whereby a stack formed from a multiplicity of such supports will be maintained in a vertical state.

In a preferred embodiment of this aspect of the invention, several such projections extend at the underside of the support to project between the adjacent ends of adjacent pairs of longitudinally aligned bottles in the layer beneath.

Further according to the invention, there is provided a stacking support for at least one row of bottles, said support being of sheet-like form with indentations shaped to receive and locate at least one row of bottles in parallel relationship in a first layer, the indentations being so arranged relative to the edges of the support that when a second like support for carrying a second layer of bottles is arranged on the bottles of the first layer, the bottles of the second layer will be laterally offset with respect to those of the first layer so that the bottles of the second layer will be supported by the bottles of the first layer, the indentations including projections engageable with the bodies of bottles of inverse taper to maintain the bottles in a substantially level orientation.

An embodiment of the invention will be now be described by way of example only with reference to the accompanying drawings in which.

As shown in the accompanying drawings a stacking support for a plurality of rows of bottles is in the form of a moulded plastics sheet. The sheet is shaped with rows 2, 4, 6, 8 of indentations 10 to receive and locate individual bottles. Each indentation 10 is shaped to locate the body of the bottle and the neck of the bottle and is relatively shallow, its depth being sufficient achieve appropriate location. The indentations 10 are so arranged in the sheet that the indentations of each of the two outer rows 2, 8 are offset by one bottle width in relation to the indentations of the adjacent inner rows 4, 6, with the adjacent pairs of outer and inner rows 2, 4 and 8, 6 being so arranged that the neck portions of the indentations of these two adjacent rows lie in laterally offset parallel arrangement across the width of the sheet as is clearly shown in FIG. 1. It will be appreciated that this configuration maximises the number of bottles which can be carried by the support as the adjacent outer and inner rows of bottles carried thereby will likewise be arranged in laterally offset relation with the bottle necks of the two rows of bottles being in uniform spaced relationship laterally offset one relative to the other. The support is formed from plastics sheets material, for example by a vacuum-forming process.

Figure 1:
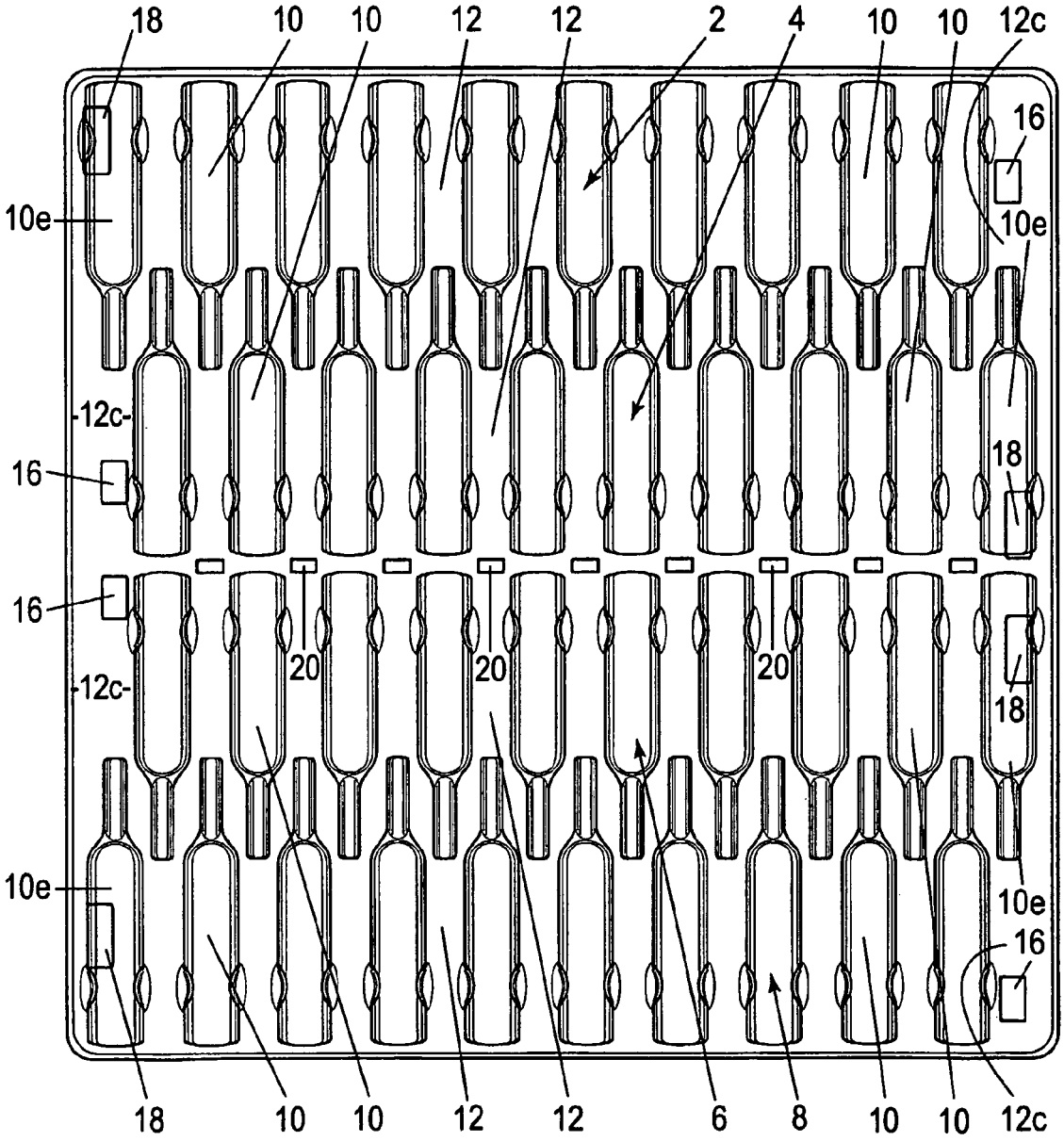
FIG. 1 is a view from above of a stacking support in accordance with an embodiment of the invention.
Figure 2:
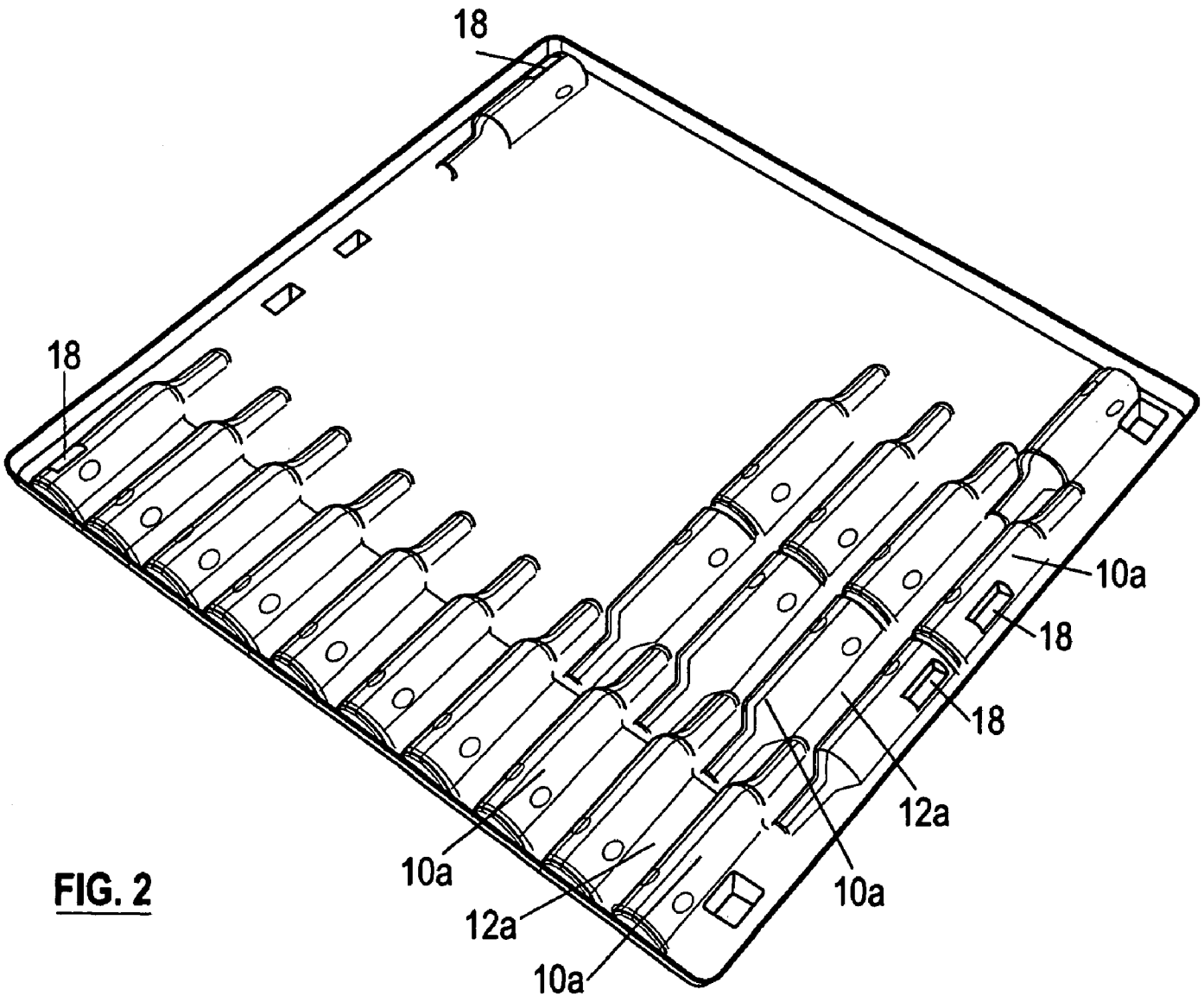
FIG. 2 is an underneath view of the stacking support.
Figure 3:
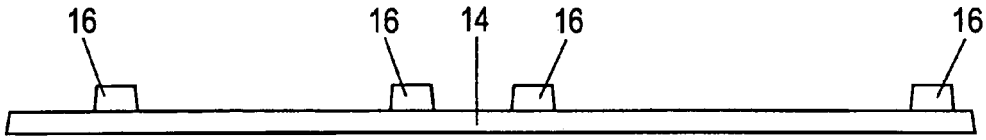
FIG. 3 is a side view of the stacking support.
Figure 4:
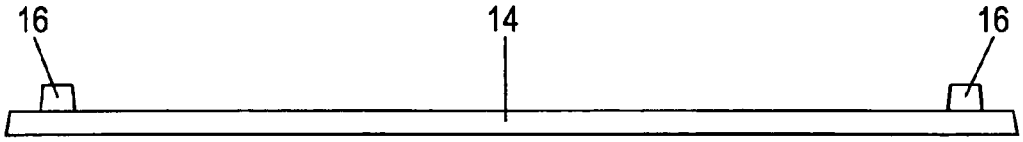
FIG. 4 is an end view of the stacking support.

In the plan view of FIG. 1, each indentation 10 is spaced from the adjacent indentation by a land 12. The configuration of indentations 10 and lands 12 in the top view of the support as shown in FIG. 1 results in a underneath configuration as shown in FIG. 2 of projections 10*a* corresponding to the indentations 10, and recesses 12*a* corresponding to lands 12. The lands 12 are of an arcuate shape whereby the corresponding underneath recess 12*a* can receive the upper part of the body of a bottle in an underlying layer of bottles formed on a like support, the bottle also lying between the projections 10*a* formed by the indentations 10 on either side of the land 12.

It will be noted from FIG. 1 that due to the offset arrangement of the adjacent rows of indentations 10, the two outer rows 2, 8 of indentations terminate closer to the left-hand edge of the support than the right hand edge, and the two inner rows 4, 6 of indentations terminate closer to the right-hand edge of the support than the left-hand edge. Accordingly, a stack of bottle layers can be formed with each bottle layer being supported and located by a support as illustrated but with the supports of the respective layers being orientated through 180° relative to the support of the immediately adjacent layer whereby the bottles in corresponding rows of adjacent layers are laterally displaced to effect interlocking and cradling between the adjacent layers.

As part of the shaping of the sheet, a downwardly-projecting peripheral skirt 14 is formed around the support and this acts to rigidify the support. It has been determined that if the sheet is formed from high impact polystyrene, the support may have sufficient rigidity for usage just due to the presence of the peripheral skirt 14. However, a plastics material such as this tends to become quite brittle after a few years due to leaching out of rubberising compounds and the plastics tends to become very susceptible to cracking and breakage. Polyethylene sheet, particularly high density polyethylene and high molecular weight polyethylene, has a significantly longer working life than high impact polystyrene but is somewhat more flexible than high impact polystyrene and the presence of the peripheral skirt 14 is not sufficient in itself to provide adequate overall rigidity for the reasons which will be discussed below. It is to be noted that of the polyethylenes just discussed, high molecular weight polyethylene is preferred due to its superior thermo-forming characteristics.

As discussed above, each of the rows of indentations 10 in the stacking support terminates closer to one edge of the support than to the opposite edge. At the opposite edge of the support it is spaced from that edge by a land 12*c* which accommodates a bottle at the end of the corresponding row in the layer immediately below in the stack. However, when considering the layer immediately above in the stack, the endmost bottle in the corresponding row will not be completely supported from below as there will only be a lower supporting bottle to one side of the upper bottle, not to both sides necessary to provide full support. In other words, that end bottle will only be partially supported by the single bottle at the end of the row beneath. Absent substantial rigidity of the stacking support itself, the partial support of the outermost bottle in each of the rows from the row beneath may result in the adjacent edge of the stacking support sagging under the weight of the only partially supported bottle. While a material such as high molecular weight polyethylene has significant advantages in terms of thermo-forming characteristics and longevity, nevertheless it can show some tendency to sagging at the ends of the rows under the conditions just described.

Figure 5:
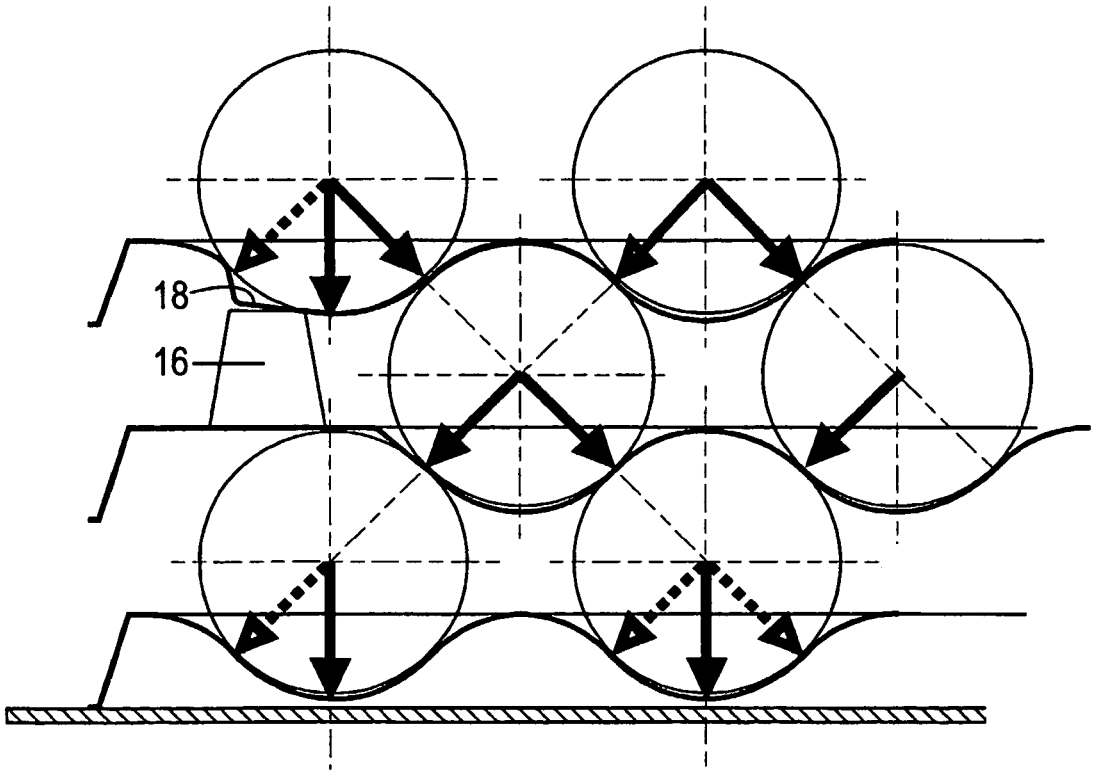
FIG. 5 shows schematically the manner in which an upwardly projecting post on the stacking support acts to provide support for an otherwise only partially supported bottle in the immediately adjacent upper row of a stack formed by using the supports.

In order to prevent sagging of the stacking support in the zones along the two opposite sides where an end bottle of a row is only partially supported by the underlying row, the support is formed with a series of short posts 16 which project upwardly from the sheet in each of the lands 12*c* between the end of each row of indentations and the edge of the support. The indentation (marked in FIG. 1 as 10*e*) at the opposite end of each row is formed with an abutment surface 18 which extends laterally outwardly from the lowest part of the indentation. As previously mentioned, when arranged in the stack each stacking support is orientated through 180° with respect to the adjacent supports immediately above and below. The posts 16 and abutment surfaces 18 of each stacking support are so arranged that the abutment surfaces 18 extending from the endmost indentations 10*e* of the support will align with and will be supported by the upwardly extending posts 16 of the immediately underlying stacking support orientated through 180° relative thereto. Accordingly, those endmost indentations 10*e* which carry the bottles which would otherwise be only partially supported by the underlying row, serve to provide full support for the bottle as its abutment surface 18 which is adjacent the otherwise unsupported edge of the sheet rests upon the upwardly extending post 16 of the underlying sheet. This is shown schematically in FIG. 5.

As shown, each of the upwardly directed posts 16 is of rectangular cross-section, preferably of tapered shape and with a substantially flat upper supporting surface. The corresponding abutment surfaces 18 are formed in the outermost part of the endmost indentations 10*e* in the portion thereof designed to receive the body of the bottle in order to maximise the support for the otherwise unsupported side of the bottle body. The abutment surface 18 is substantially flat so as to sit on the flat upper face of the underlying upstanding post 16. As will be appreciated, the sets of posts 16 and abutment surfaces 18 are formed in the sheet as part of the moulding process.

It will be noted from FIG. 1 that the sets of upwardly directed posts 16 arranged at the two opposite sides of the stacking support are asymmetric about the central lateral axis of the support (that is the centre line running between the two inner rows 4, 6 of indentations). This asymmetry is of significance in a situation where a stacking support is inverted and applied to the uppermost layer of bottles in a stack to form a cover for that layer as may occur when the stack is palletised and strapped and/or shrink-wrapped. In that case, the asymmetry of the upstanding posts 16 means that the posts on the inverted uppermost support will be offset from the those of the support carrying the upper layer whereby the uppermost support which acts as a cover for the stack can nest very securely into the bottles of the uppermost layer.

In the embodiment shown, a series of downwardly directed lips 20 are formed along the central lateral axis of the support aligned with the lands between adjacent indentations of the two inner rows 4, 6. Similar sets of lips (not shown) may be associated with each of the two outer rows each aligned with a respective land between adjacent, bottles and each lying adjacent the edge of the support. Each of these lips is adapted to lie immediately adjacent the bottom of the corresponding bottle in the underlying row. These rows of lips which are also formed as part of the moulding process thereby act as stops engageable with the bottoms of the bottles to thereby substantially prevent relative displacement between the stacking supports and the bottles in a direction parallel to the longitudinal axis of the bottles. This will ensure that the stack will remain in a vertical condition. In circumstances where the indentations of the stacking support are designed to carry a wide variety of different wine bottles, depending on the actual bottle used some longitudinal displacement may be able to occur between a support and the underlying layer of bottles. Absent means such as just described to prevent or at least substantially restrict the possibility of such longitudinal displacement a situation could arise in which a progressive longitudinal slip can occur from layer to layer within the stack whereby upper layers of the stack may have a significant offset from the lower layers.

In an alternative arrangement, maintenance of the stack in a vertical condition can be achieved by shaping the cooperating parts of the posts 16 and abutment surfaces 18 in such a manner that they also cooperate to prevent relative movement between the adjacent supports in a horizontal plane, for example by forming a lip around the abutment surface 18 and within which the upper end of the post is seated, or otherwise forming co-operating structure to receive and locate the upper end of the post. Alternatively, the two adjacent supports can be formed with other interengaging structure such as projections and recesses for the sole purpose of preventing horizontal displacement between the adjacent supports and to thereby maintain the stack in a vertical condition.

It is to be understood that the various different methods as described for substantially preventing horizontal displacement between adjacent supports to maintain the stack in a vertical condition also have significant utility in supports which do not incorporate the "anti-sag" features, for example in supports having sufficient inherent rigidity due to the design of the support and/or due to the material from which the support is formed, that sagging does not substantially arise. In that case, when horizontal displacement is prevented by the use of posts equivalent to the posts 16 which seat in recesses (or otherwise cooperate with corresponding structure) in the overlying support, the posts and recesses (or other structure) may be located in different positions to those specifically illustrated.

In the embodiment described, the stacking support is designed to carry four rows of bottles and the number of bottles and hence the overall size of the sheet is such that it is of a size equivalent to that of a standard pallet. It is however to be understood that the principals of the invention are applicable to stacking supports designed to carry more than four rows or less than four rows, for example two rows or even a single row. Although as shown each row of indentations has a single post 16 in the zone of its land 12*c*, if required for additional support additional posts and cooperating abutments surfaces 18 can be incorporated and/or each post and cooperating abutment surface can be of extended axial length in the direction of the axes of the bottles.

Figure 6:
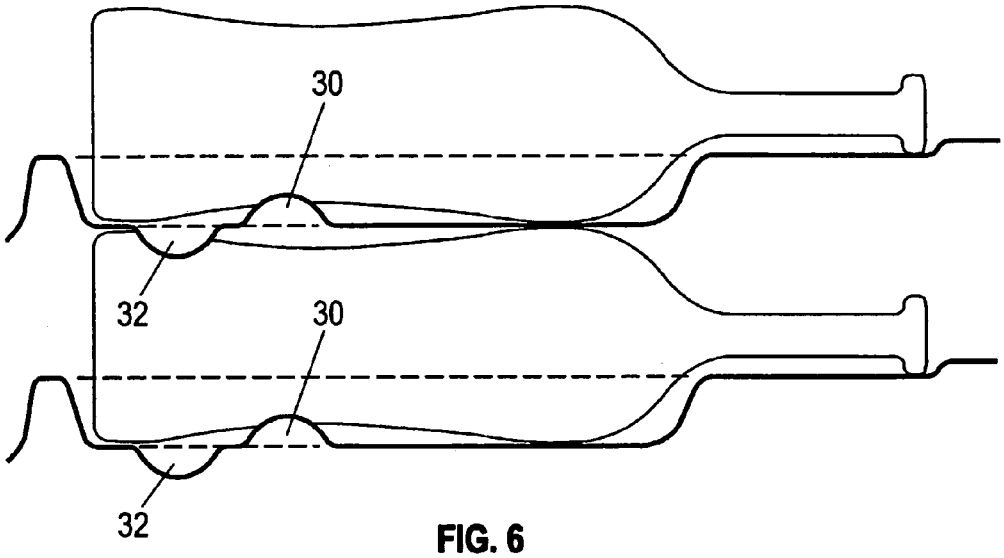
FIG. 6 shows a modification in the design of the indentations of the stacking support specifically for use with bottles having an inverse taper.

FIG. 6 shows a modification in which each indentation 10 is shaped to provide a pair of upstanding projections 30 to engage opposite sides of the body of a bottle of inverse taper to maintain the base part of the bottle slightly raised from the base of the indentations so that the bottle itself is held substantially level. A corresponding pair of projections 32 is directed downwardly from the base of the indentation to contact the bodies of the adjacent bottles in the layer beneath to ensure that the upper layer is supported in a substantially level fashion from the layer beneath.

The projections 30, 32 avoid problems which might otherwise arise in stacking inverse tapered bottles which would not, otherwise, be level and which might, under some circumstances, give rise to stability problems within the overall stack.

Although the projections just described are specifically intended for use with a stacking support designed for inverse tapered bottles, they may also be incorporated within stacking supports for use with regular shaped bottles with the projections then flattening to accommodate the regular shaped bottles and thereby become inoperative in that mode.

The embodiment has been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

The invention claimed is:

1. A stacking support system for bottles comprising:

a first support member adapted to carry a plurality of bottles comprising a first layer of bottles; and a second support member adapted to carry a plurality of bottles comprising a second layer of bottles;

said first and second support members each comprising:

a plurality of indentations arranged in at least one row and shaped to receive and locate a plurality of bottles in a parallel relationship; and at least one of a first projection adjacent to an end of said at least one row;

wherein said second support member is stacked in a vertical direction upon said first support member in a manner such that said second support member is rotated 180° relative to said first support member and said second layer of bottles nests with said first layer of bottles such that bottles of said second layer of bottles rest between adjacent pairs of bottles of said first layer of bottles;

and wherein said at least one of a first projection of said first support member supports at least one bottle of said second layer of bottles.

2. A stacking support system according to claim 1, wherein said at least one of a first projection comprises a post extending upwardly from said first support member;

and wherein at least one indentation located at an opposite end of said at least one row of said second support member comprises an abutment surface, said abutment surface supported by said post.

3. A stacking support system according to claim 2, wherein said post is located between said indentation at said end of said at least one row and an edge of said first support member;

and wherein said abutment surface extends from a laterally outer side of said at least one indentation.

4. A stacking support system according to claim 2, wherein each support member comprises a plurality of indentations arranged in a plurality of rows, a first projection comprising a post located adjacent to an end of each of said plurality of rows and an indentation comprising an abutment surface located at an opposite end of each of said plurality of rows.

5. A stacking support system according to claim 1, further comprising at least one of a second projection extending downwardly from said second support member and engaging at least one bottle of said first layer of bottles.

6. A stacking support system according to claim 1, further comprising means operable to inhibit relative displacement between said first support member and said second support member in a direction parallel to the longitudinal axes of said bottles.

7. A stacking support system according to claim 1, wherein said projection extending from said first support member engages said second support member in a manner substantially to prevent displacement between said first and second support members in a direction parallel to the longitudinal axes of said bottles.

8. A stacking support system according to claim 1, wherein each said indentation comprises at least one of a second projection operable to maintain at least one of said bottles in a substantially level orientation.

9. A stacking support system according to claim 8, wherein each said indentation further comprises at least one of a third projection extending downwardly and engaging bottles of an underlying layer of bottles.

10. A stacking support system according to claim 1, wherein said at least one of a first projection extends upwardly from said first support member in manner substantially to engage a complimentary structure at an undersurface of said second support member.

* * * * *